US011725331B2

(12) United States Patent
Rajendran

(10) Patent No.: US 11,725,331 B2
(45) Date of Patent: Aug. 15, 2023

(54) WATER RECIRCULATION ASSEMBLY FOR A LAUNDRY APPLIANCE

(71) Applicant: WHIRLPOOL CORPORATION, Benton Harbor, MI (US)

(72) Inventor: Arun Rajendran, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 161 days.

(21) Appl. No.: 16/953,934

(22) Filed: Nov. 20, 2020

(65) Prior Publication Data

US 2022/0162792 A1 May 26, 2022

(51) Int. Cl.

| | |
|---|---|
| ***D06F 39/08*** | (2006.01) |
| ***D06F 39/14*** | (2006.01) |
| ***D06F 37/26*** | (2006.01) |
| *D06F 21/04* | (2006.01) |
| *D06F 37/28* | (2006.01) |

(52) U.S. Cl.

CPC ..... *D06F 39/083* (2013.01); *D06F 37/267* (2013.01); *D06F 39/085* (2013.01); *D06F 39/088* (2013.01); *D06F 39/14* (2013.01); *D06F 21/04* (2013.01); *D06F 37/28* (2013.01)

(58) Field of Classification Search

CPC .... D06F 37/267; D06F 39/083; D06F 39/085; D06F 39/088; D06F 39/14

See application file for complete search history.

(56) References Cited

U.S. PATENT DOCUMENTS

| | | | | |
|---|---|---|---|---|
| 2014/0299164 | A1* | 10/2014 | Zhang | D06F 33/43 134/199 |
| 2015/0121969 | A1 | 5/2015 | Lim et al. | |
| 2015/0211167 | A1* | 7/2015 | Kim | D06F 31/00 68/3 R |
| 2019/0330780 | A1 | 10/2019 | Jung et al. | |
| 2019/0368113 | A1 | 12/2019 | Lee et al. | |
| 2020/0087837 | A1 | 3/2020 | Romito et al. | |
| 2020/0248371 | A1* | 8/2020 | Lee | D06F 37/22 |
| 2020/0248381 | A1* | 8/2020 | Lee | D06F 37/04 |
| 2020/0399817 | A1* | 12/2020 | Tartuferi | D06F 39/088 |

FOREIGN PATENT DOCUMENTS

| | | | | |
|---|---|---|---|---|
| CN | 1231357 | A * | 10/1999 | D06F 25/00 |
| DE | 4330079 | A1 * | 3/1995 | D06F 37/28 |
| DE | 4330079 | A1 | 3/1995 | |
| EP | 1634987 | | 3/2006 | |
| EP | 2711452 | | 3/2014 | |
| EP | 2902541 | | 8/2015 | |

(Continued)

OTHER PUBLICATIONS

Machine translation of DE-4330079-A1 to Moscheutz. (Year: 1995).*

*Primary Examiner* — Joseph L. Perrin

(74) *Attorney, Agent, or Firm* — Price Heneveld LLP

(57) ABSTRACT

A laundry appliance includes a cabinet that includes a pump. A drum is disposed within the cabinet and a tub is operably coupled to the drum and is disposed proximate to the cabinet. A water recirculation assembly is operably coupled to the pump. The water recirculation assembly includes a first tube that is operably coupled to the pump within the cabinet, a second tube that is fluidly coupled to the first tube, and a gap that is defined between the first tube and the second tube.

14 Claims, 8 Drawing Sheets

(56) References Cited

FOREIGN PATENT DOCUMENTS

| | | | |
|---|---|---|---|
| EP | 3290572 | A1 | 3/2018 |
| EP | 3530798 | A1 | 8/2019 |
| ES | 2113792 | | 5/1998 |
| ES | 2446115 | | 3/2014 |
| KR | 100565479 | B1 | 3/2006 |
| KR | 101461390 | B1 | 11/2014 |
| WO | 2019201113 | A1 | 10/2019 |

* cited by examiner

WATER RECIRCULATION ASSEMBLY FOR A LAUNDRY APPLIANCE

BACKGROUND OF THE DISCLOSURE

The present disclosure generally relates to a laundry appliance, and more specifically, to a water recirculation assembly for a laundry appliance.

SUMMARY OF THE DISCLOSURE

According to one aspect of the present disclosure, a laundry appliance includes a cabinet that includes a pump and a door proximate to the cabinet. A tub is disposed within the cabinet and is proximate to the door and is operably coupled to the drum. A water recirculation assembly is operably coupled to the cabinet and the door and is disposed proximate to the tub. The water recirculation assembly includes a first tube that is attached to the cabinet and is operably coupled to the pump, a second tube that is operably coupled to the door, and a gap that is defined between the first tube and the second tube.

According to another aspect of the present disclosure, a laundry appliance includes a cabinet that includes a pump. A drum is disposed within the cabinet and a tub is operably coupled to the drum. A water recirculation assembly is coupled to the tub. The water recirculation assembly includes an inlet tube, and a manifold tube is coupled to the inlet tube. The manifold tube defines a plurality of apertures along at least a portion of the manifold tube.

According to yet another aspect of the present disclosure, a laundry appliance includes a cabinet that includes a pump. A drum is disposed within the cabinet and a tub is operably coupled to the drum and is disposed proximate to the cabinet. A water recirculation assembly is operably coupled to the pump. The water recirculation assembly includes a first tube that is operably coupled to the pump within the cabinet, a second tube that is fluidly coupled to the first tube, and a gap that is defined between the first tube and the second tube.

These and other features, advantages, and objects of the present disclosure will be further understood and appreciated by those skilled in the art by reference to the following specification, claims, and appended drawings.

Figure 1:
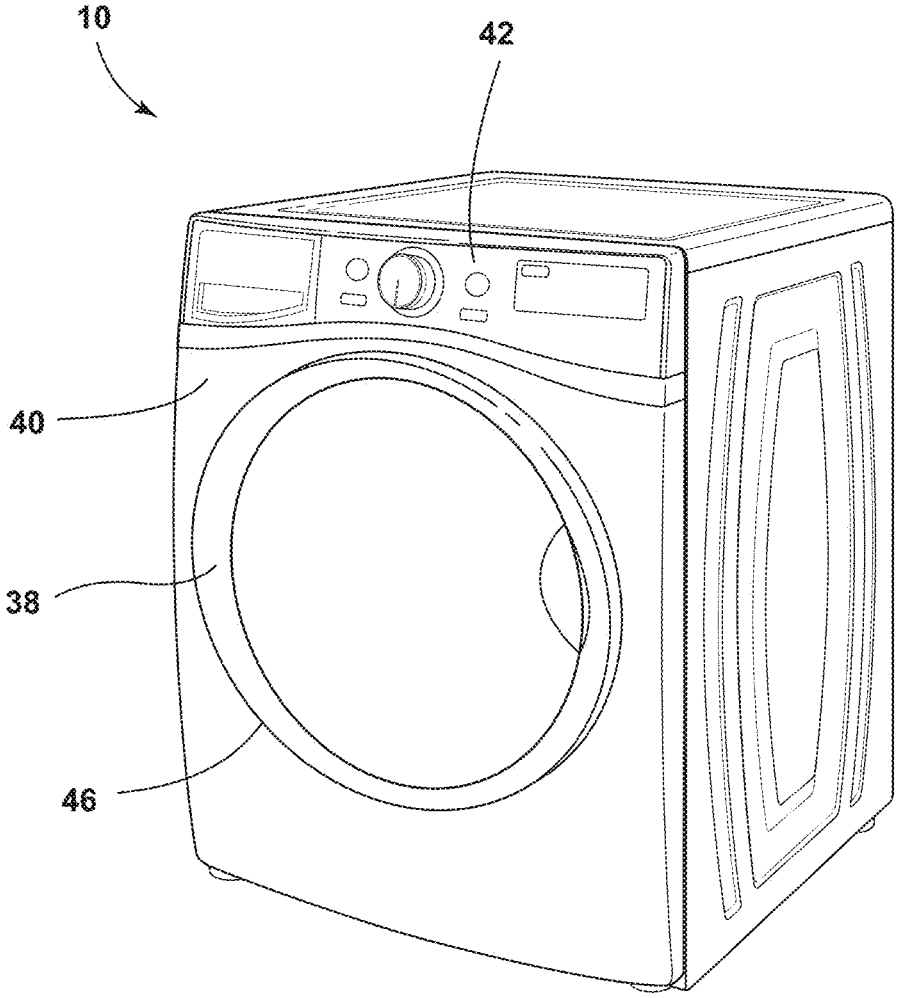
FIG. 1 is a front perspective view of a laundry appliance of the present disclosure.

The components in the figures are not necessarily to scale, emphasis instead being placed upon illustrating the principles described herein.

DETAILED DESCRIPTION

The present illustrated embodiments reside primarily in combinations of apparatus components related to a water recirculation assembly. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-11, reference numeral 10 generally designates a laundry appliance that includes a cabinet 12 with a pump 14. A door 16 is positioned proximate to the cabinet 12 and includes an outer frame 18 and a central portion 20. A drum 22 is positioned within the cabinet 12, and a tub 24 is proximate to the door 16 and operably coupled to the drum 22. A water recirculation assembly 26 can be operably coupled to the cabinet 12 and the door 16.

The water recirculation assembly 26 is also disposed proximate to the tub 24. The water recirculation assembly 26 includes a first tube 28 that is operably coupled to the pump 14 and a second tube 30 can be operably coupled to the door 16. A gap 32 can be defined between the first tube 28 and the second tube 30.

Figure 2:
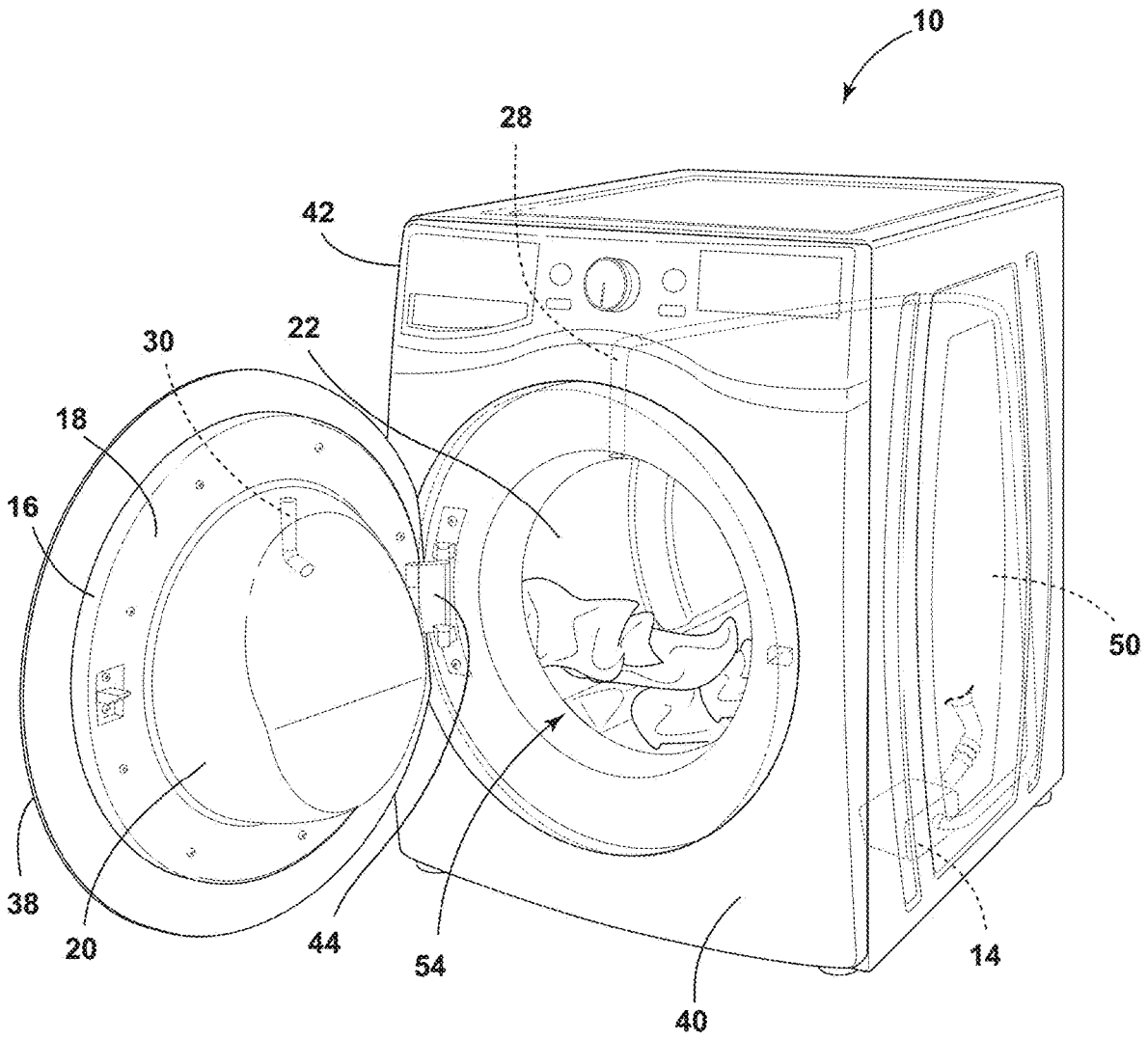
FIG. 2 is a front perspective view of a laundry appliance with a water recirculation assembly of the present disclosure.
Figure 3:
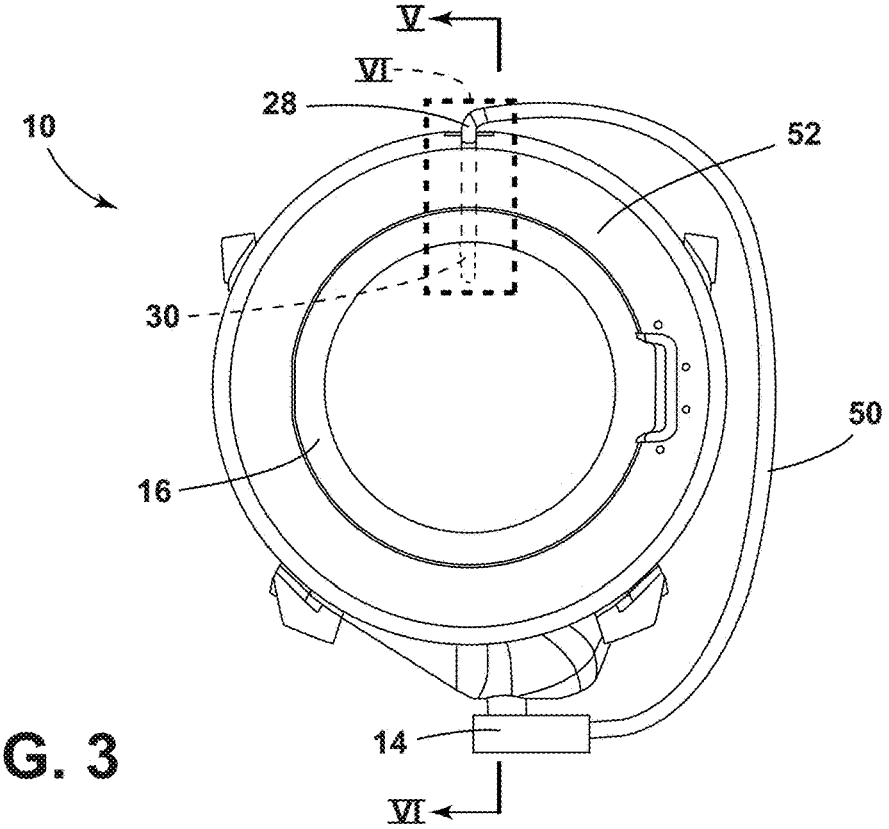
FIG. 3 is a front elevational view of a water recirculation assembly of the present disclosure coupled to a pump of a laundry appliance with a second tube in a first position.
Figure 4:
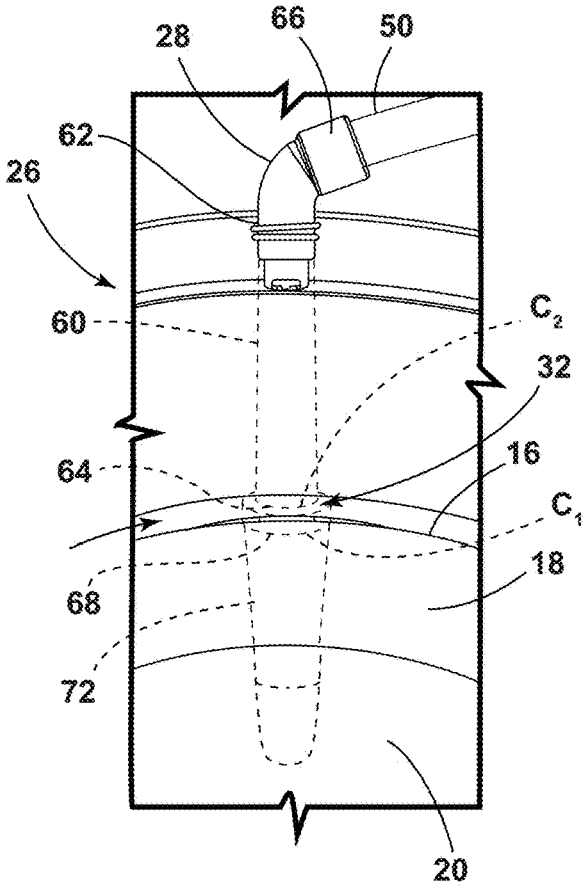
FIG. 4 is an enlarged partial front elevational view of the water recirculation assembly of FIG. 3 taken at area IV.
Figure 5:
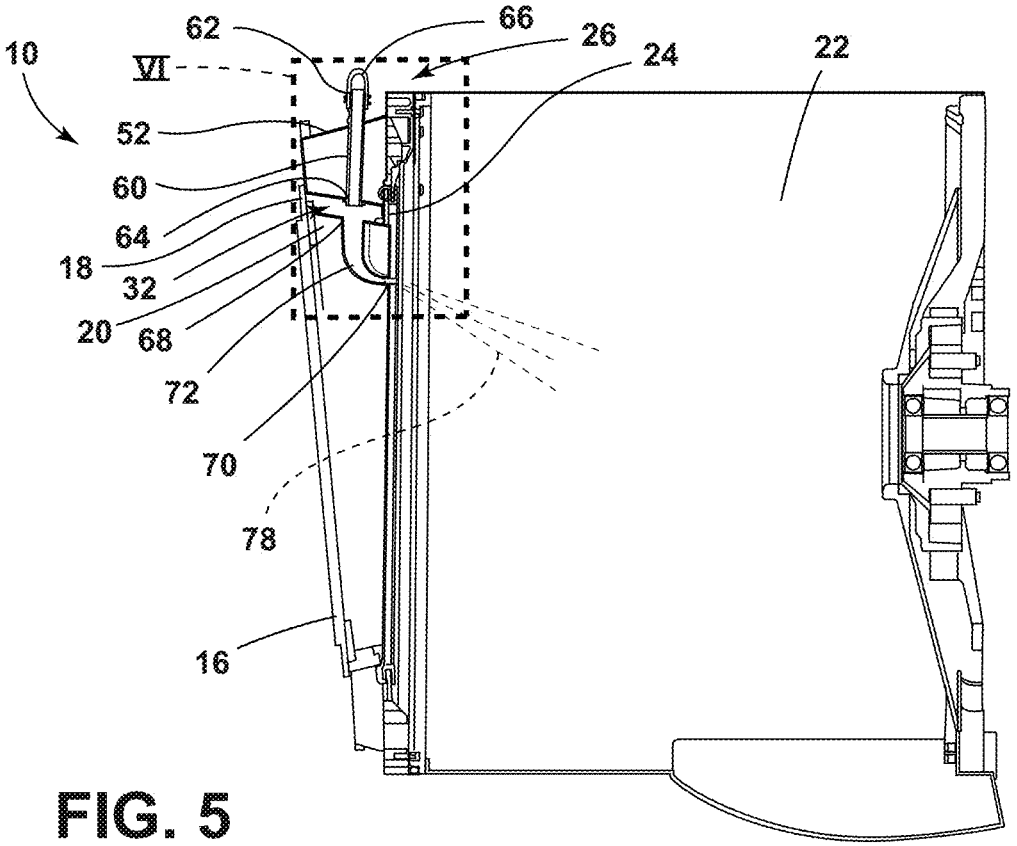
FIG. 5 is a side cross-sectional view of the water recirculation of FIG. 4 taken at lines V-V.
Figure 6A:
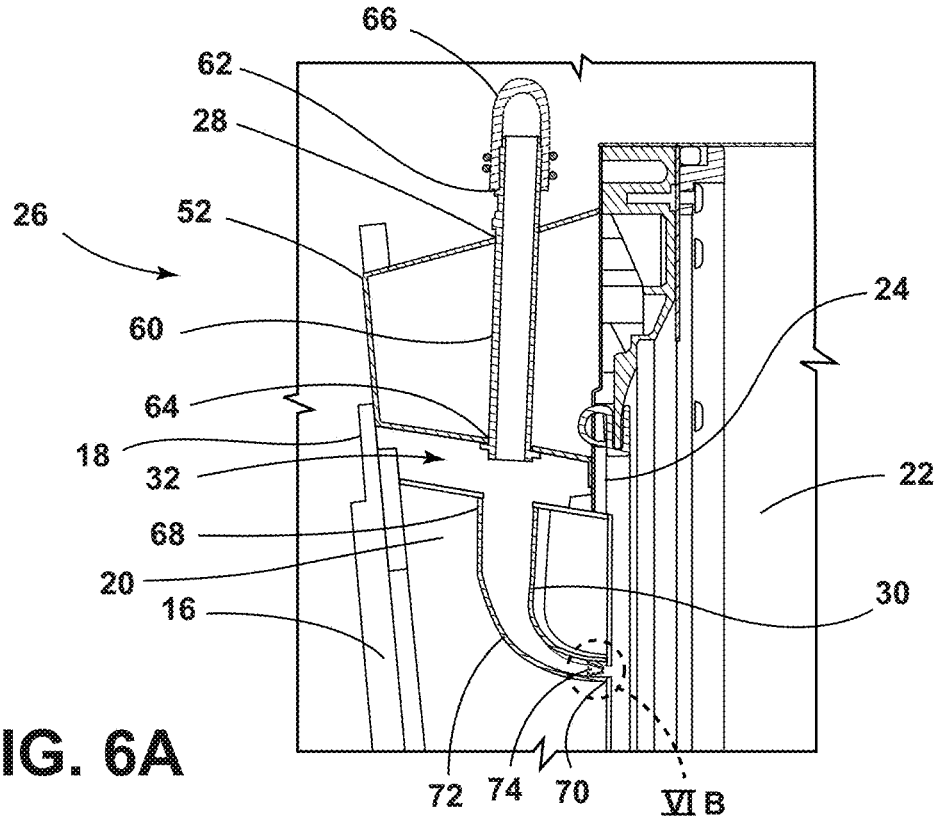
FIG. 6A is an enlarged cross-sectional view of the water recirculation assembly of FIG. 5 taken at area VI.
Figure 6B:
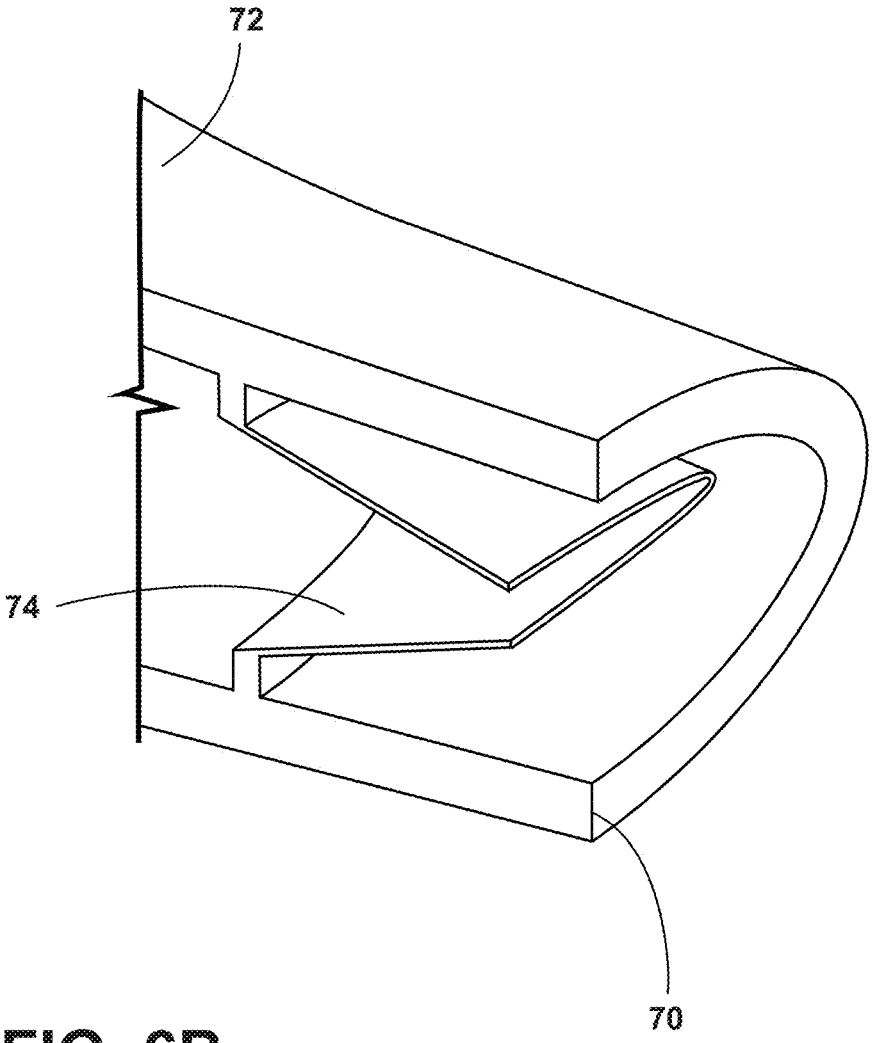
FIG. 6B is an enlarged cross-sectional view of a valve of the water recirculation assembly of FIG. 6A taken at area VIB.
Figure 7:
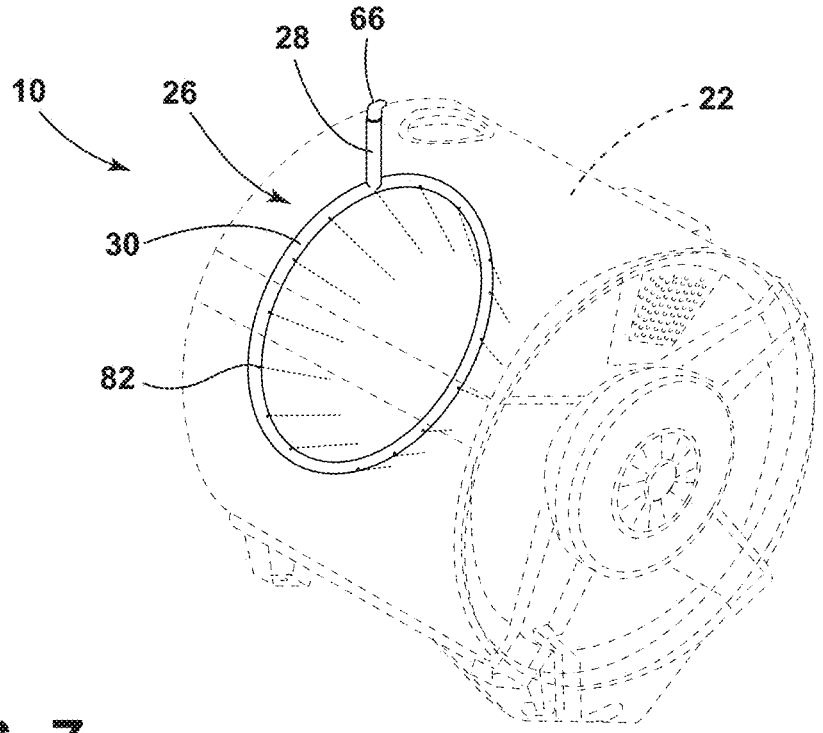
FIG. 7 is a rear perspective view of a water recirculation assembly of the present disclosure operably coupled to a drum illustrated in phantom.
Figure 8:
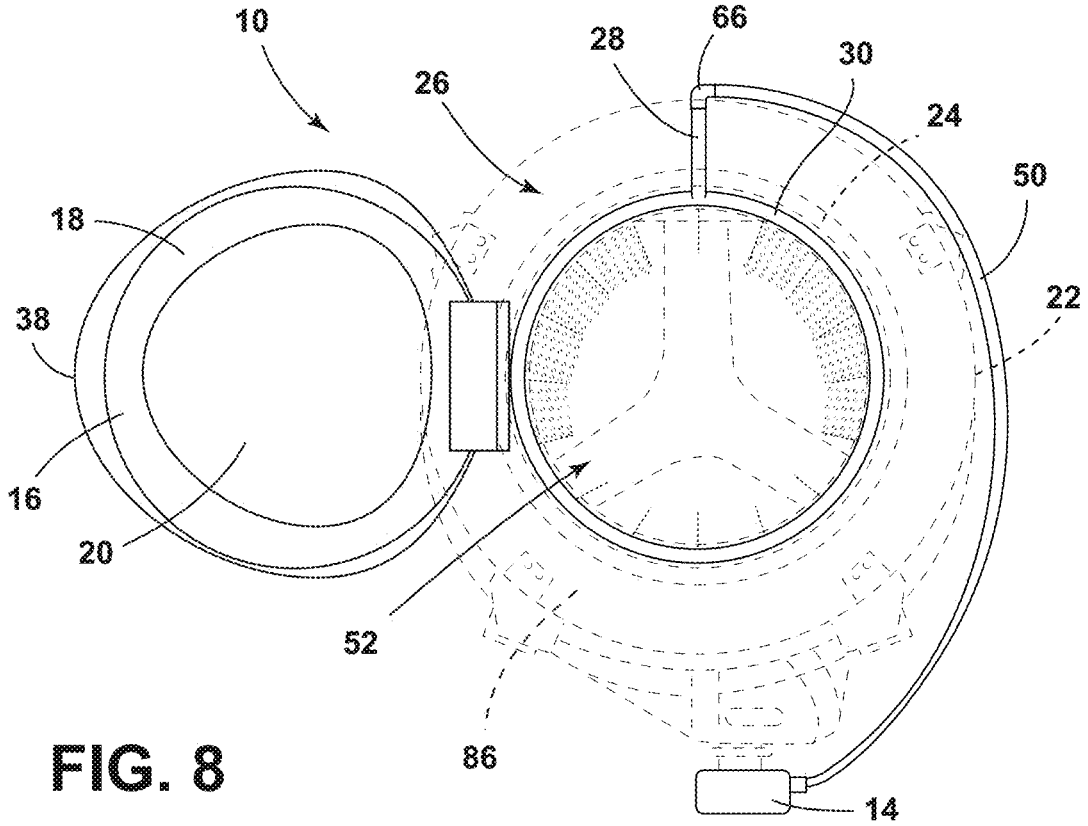
FIG. 8 is a front elevational view of an aspect of the water recirculation assembly.

Referring to FIGS. 1-3, the cabinet 12 of the laundry appliance 10 includes an aesthetic door 38 coupled to a front panel 40 that surrounds the door 16 and includes a user interface 42. The aesthetic door 38 is coupled to the front panel 40 of the cabinet 12, and the door 16 is coupled to the tub 24 proximate to the front panel 40. The aesthetic door 38 and the door 16 are operable between opened and closed positions 44, 46. The aesthetic door 38 and the door 16 may be a flat panel door, a fishbowl style door, or a combination thereof. The door 16 is configured to provide access to the drum 22 positioned within the cabinet 12 when the door 16 is in the open position 44 and encloses the tub 24 and the drum 22 when the door 16 is in the closed position 46. The door 16 includes the central portion 20 and the outer frame 18 disposed around the central portion 20. It is generally contemplated that the central portion 20 can be transparent. However, it is also contemplated that the central portion 20 may be opaque and/or translucent.

As mentioned above, the cabinet 12 includes the pump 14, which is configured to collect a liquid 48 and ultimately circulate the liquid 48 to be disposed within the drum 22, described in more detail below. The pump 14 is generally housed within the cabinet 12 and is fluidly coupled to the water recirculation assembly 26. The pump 14 can be positioned within the cabinet 12 beneath the drum 22 and includes a hose 50. The hose 50 extends from the pump 14 and is routed toward the first tube 28. The liquid 48 described herein is generally contemplated to be water, but may also include a combination of water and detergent, recycled water, or other liquids and chemistries typically collected and circulated by the pump 14. The hose 50 dispenses the liquid 48 from the pump 14 to the first tube 28, described further below.

With further reference to FIGS. 1-3, a frame 52 is coupled to the tub 24 and generally surrounds the door 16 in the closed position 46 of the door 16. The frame 52 is disposed behind the front panel 40 to conceal the frame 52, and the door 16 may generally flush with the cabinet 12, such that the door 16 may be generally aligned with the front panel 40 and surrounded by the frame 52. The first tube 28 is operably coupled to the frame 52. The first tube 28 is generally fixed relative to the frame 52. Stated differently, the first tube 28 may be integrally formed with the frame 52 to the extent that the first tube 28 is disposed within the frame 52. The central portion 20 of the door 16 is generally spaced apart from the frame 52. In this configuration, the first tube 28 is disposed within the frame 52 and is spaced apart from the second tube 30 that is operably coupled to the door 16. This general separation of the frame 52 and the central portion 20 of the door 16 also defines the gap 32 between the first tube 28 and the second tube 30.

As mentioned above, the door 16 is operably coupled to the tub 24 proximate to the drum 22. The tub 24 and the drum 22 define an opening 54 through which articles, such as clothing, are disposed within the drum 22 to be processed. The door 16 provides selective access to the drum 22 via the opening 54. The door 16 is configured to cover the opening 54 in the closed position 46 of the door 16 and provide access to the opening 54 in the open position 44 of the door 16. As described in more detail below, the door 16 may be in fluid communication with the drum 22, such that the liquid 48 may enter the drum 22 proximate to the door 16 and through the opening 54.

Referring to FIGS. 3-6, the first tube 28 of the water recirculation assembly 26 is disposed within the frame 52 of the cabinet 12, and the second tube 30 of the water recirculation assembly 26 is disposed within the door 16 proximate to the tub 24. Stated differently, the first tube 28 extends through the frame 52 toward the door 16, and the second tube 30 extends from the central portion 20 proximate to the first tube 28 through the central portion 20 toward the drum 22. The second tube 30 may be referred to as a water distribution feature and is configured to distribute the liquid 48 into the drum 22. The first tube 28 may be referred to as an inlet tube, and the inlet tube 28 includes a linear body 60 that includes a first end 62 and a second end 64.

The inlet tube 28 also includes an inlet feature 66 that is operably coupled to the first end 62 of the inlet tube 28 and to the hose 50 of the pump 14. The inlet feature 66 is configured to receive the liquid 48 from the pump 14 and deliver the liquid 48 through the first end 62 of the inlet tube 28. The liquid 48 passes from the first end 62 through the linear body 60 and out the second end 64 of the inlet tube 28. The liquid 48 then passes from the second end 64 of the inlet tube 28, across the gap 32, and is received by the second tube 30. Stated differently, the second end 64 of the linear body 60 is positioned proximate to the second tube 30 and directs the liquid 48 into the second tube 30 through the gap 32. The translation of the liquid 48 across the gap 32 is facilitated by gravity, such that the liquid 48 is directed into the second tube 30, at least in part due to gravity. The second tube 30 includes a receiving end 68 proximate to the second end 64 of the inlet tube 28 and a distribution end 70 proximate to the drum 22.

With further reference to FIGS. 3-6B, it is generally contemplated that the distribution end 70 is generally curved to direct or redirect the liquid 48 received by the receiving end 68 toward the drum 22. The second tube 30 also includes a curved central body 72 between the receiving end 68 and the distribution end 70 that promotes a laminar flow of fluid 48 toward the drum 22. As mentioned above, the receiving end 68 of the second tube 30 receives the liquid 48 from the first tube 28 via the second end 64 of the first tube 28. The liquid 48 enters the drum 22 via the distribution end 70 of the second tube 30, such that the liquid 48 is projected from the distribution end 70 past the tub 24 and into the drum 22. The second tube 30 also includes a valve 74 disposed within the distribution end 70 configured to direct the liquid 48 through the second tube 30 and into the drum 22 while preventing backflow of the liquid 48 from the drum 22 into the second tube 30. The valve 74 may be described as being a check valve meaning the liquid 48 can flow through the valve 74 in one direction, toward the drum 22. The door 16 is operably coupled to the tub 24, such that the second tube 30 is, in turn, operably coupled to the tub 24 via the door 16. This configuration of the second tube 30 being coupled to the door 16 helps to further promote laminar flow of the liquid 48 toward the drum 22.

It is generally contemplated that the door 16 and the second tube 30 are configured to wobble, oscillate or otherwise move, with a movement path of the tub 24, such that the door 16 may move within the cabinet 12. It is also contemplated that the first tube 28 may have some movement along with the tub 24 as the frame 52 is operably coupled to the tub 24 and the first tube 28 is fixed within the frame 52. A first position of the water recirculation assembly 26 is defined when the second tube 30 is centrally aligned to the first tube 28. In the first position, the second end 64 of the first tube 28 is concentrically aligned with the receiving end 68 of the second tube 30. As the door 16 moves with the tub 24, the second tube 30 is generally displaced from the first tube 28, such that the second tube 30 is defined in a second position of the water recirculation assembly 26. While the second tube 30 is displaced, the receiving end 68 of the second tube 64 is still positioned beneath the first tube 28, such that the second tube 28 may still receive the liquid 48 in the second position. Specifically, the receiving end 68 of the second tube 30 has a larger opening than the second end 64 of the first tube 28. Stated differently, the receiving end 68 of the second tube 30 has a circumference $C_1$ that is larger than a circumference $C_2$ of the first tube 28. The second position is defined by the first second tube 30 being generally offset or out of alignment with the second tube 30 as compared to the vertical alignment of the first and second tubes 28, 30 in the first position. Despite being offset, the first tube 28 can still transfer the liquid 48 through the second tube 30 as a result of the size difference between the first tube 28 and the second tube 30.

Referring still to FIGS. 3-6B, as the laundry appliance 10 performs a cycle, the tub 24, the frame 52, and the door 16 wobble and oscillate such that the second tube 30 is generally misaligned, as mentioned above, with the first tube 28. Upon completion of the laundry cycle, the oscillations cease and the second tube 30 reenters the first position and is realigned with the first tube 28. The laundry appliance 10 may operate the water recirculation assembly 26 to distribute additional liquid 48 through the first and second tubes 28, 30 and into the drum 22, for example, during a rinse cycle. The routine may be repeated as few or as many times based on a selected laundry cycle and/or based on any potential cleanliness detection by internal sensors.

The separation of the first and second tubes 28, 30 may extend the overall useful life of the water recirculation assembly 26 by embedding the first tube 28 within the frame 54 and the second tube 30 within the door 16. The water recirculation assembly 26 provides an improved distribution of the liquid 48 by directly distributing the liquid 48 into the drum 22 via the water recirculation assembly 26. As such, the laundry appliance 10 is generally free from bellows, which may maximize the overall cleanliness and useful life of the laundry appliance 10.

Referring now to FIGS. 7-11, the water recirculation assembly 26 described above is illustrated in an alternative configuration disposed between the tub 24 and the drum 22. In this configuration, the second tube 30 may be referred to as a manifold tube and is coupled to the inlet tube 28. The manifold tube 30 includes a circumferential body 80 that defines a plurality of apertures 82 along at least a portion of the circumferential body 80. It is generally contemplated that the inlet tube 28 may be coupled to the frame 52, as described above, or the inlet tube 28 may be integrated with the tub 24, described below.

The plurality of apertures 82 may include any number of apertures 82 defined along the circumferential body 80, such that more apertures 82 or fewer apertures 82 than those illustrated may be defined depending on the size and configuration of the laundry appliance 10. The apertures 82 may be circular, rectangular, triangular, or any other shape generally known in the art. The apertures 82 can be evenly spaced along the circumferential body 80 or may, alternatively, be grouped at predefined portions along the circumferential body 80. If the apertures 82 are grouped, the portions at which the apertures 82 are defined may maximize the distribution of the liquid 48 to particular areas within the drum 22 to improve the overall efficiency of the laundry appliance 10.

As illustrated, the plurality of apertures 82 are generally evenly spaced along the circumferential body 80. The circumferential body 80 is illustrated as a circular body. Additionally or alternatively, the circumferential body 80 may be crescent shaped or any other radial configuration that at least partially extends around the opening 54 defined by the drum 22 and is generally congruent with the shape of the opening 54. It is also contemplated that the manifold tube 30 is generally concentrically aligned with the drum 22, such that the manifold tube 30 is aligned with the opening 54 of the drum 22. Thus, the drum 22 generally surrounds, or extends beyond, the manifold tube 30.

With further reference to FIGS. 7-11, a space 84 is defined between the tub 24 and the drum 22, such that the water recirculation assembly 26 is disposed within the space 84 between the tub 24 and the drum 22. As mentioned above, the frame 52 is operably coupled to the tub 24 proximate to the door 16 and at least partially defines the opening 54. The outer frame 18 of the door 16 is generally disposed proximate to the frame 52 and the tub 24. As described in more detail below, the water recirculation assembly 26 can be operably coupled to the frame 54 and the tub 24. As mentioned above, the inlet tube 28 is operably coupled to the pump 14 via the inlet feature 66 of the first end 62 of the inlet tube 28. The inlet tube 28 directs the liquid 48 from the pump 14 through the manifold tube 30. The water recirculation assembly 26 is configured to dispense the liquid 48 from the pump 14 into the drum 22, which is facilitated by the positioning of the water recirculation assembly 26 in the space 84 defined between the tub 24 and the drum 22.

Figure 9:
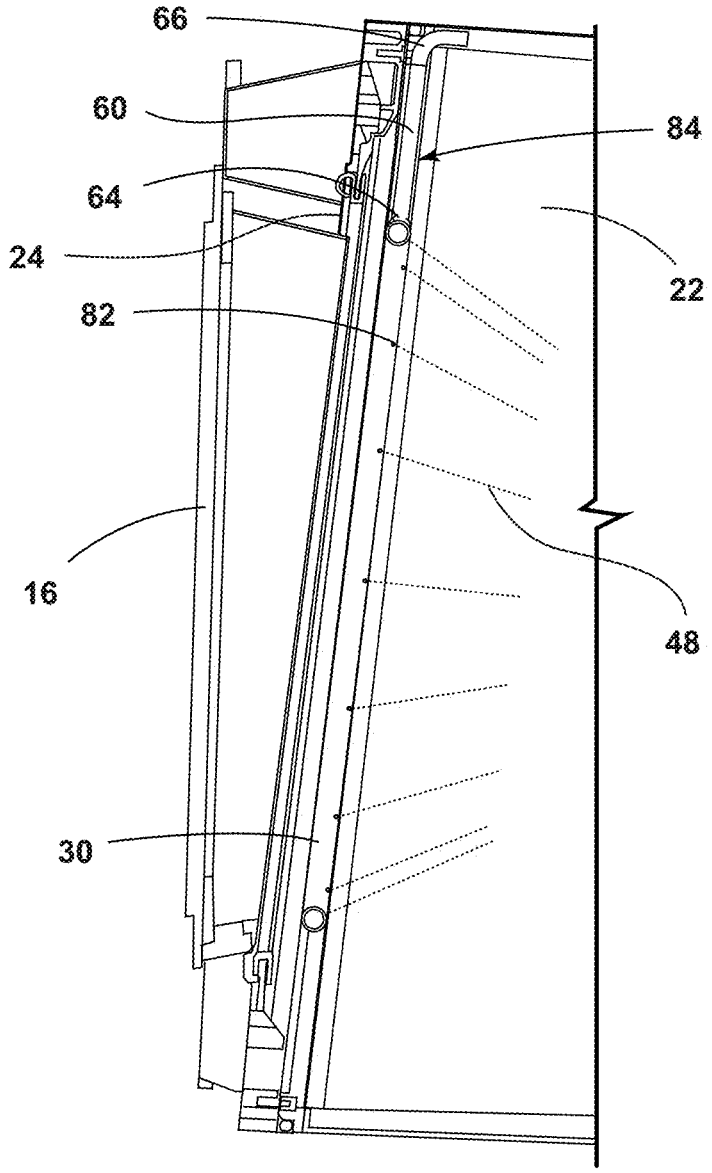
FIG. 9 is a schematic cross-sectional view of a laundry appliance of the present disclosure with an aspect of the water recirculation assembly and illustrating exemplary fluid streams.

As illustrated in FIG. 9, the inlet feature 66, mentioned above, is operably coupled to the first end 62 of the inlet tube 28 and is configured to direct the liquid 48 from the pump 14 to the inlet tube 28. The inlet tube 28 can be integrally formed with the tub 24, such that the linear body 60 is defined by the tub 24. It is further contemplated that the inlet tube 28 is directly coupled to the manifold tube 30 at the receiving end 68 of the manifold tube 30. As illustrated in FIG. 9, the receiving end 68 of the manifold tube 30 is coupled to the circumferential body 80 at a receiving opening 88 of the manifold tube 30. The receiving opening 88 is defined by the circumferential body 80 and is generally proximate to the second end 64 of the inlet tube 28. It is also contemplated that the second end 64 of the inlet tube 28 may be integrally formed with the circumferential body 80 of the manifold tube 30 proximate to the receiving opening 88.

Figure 10:
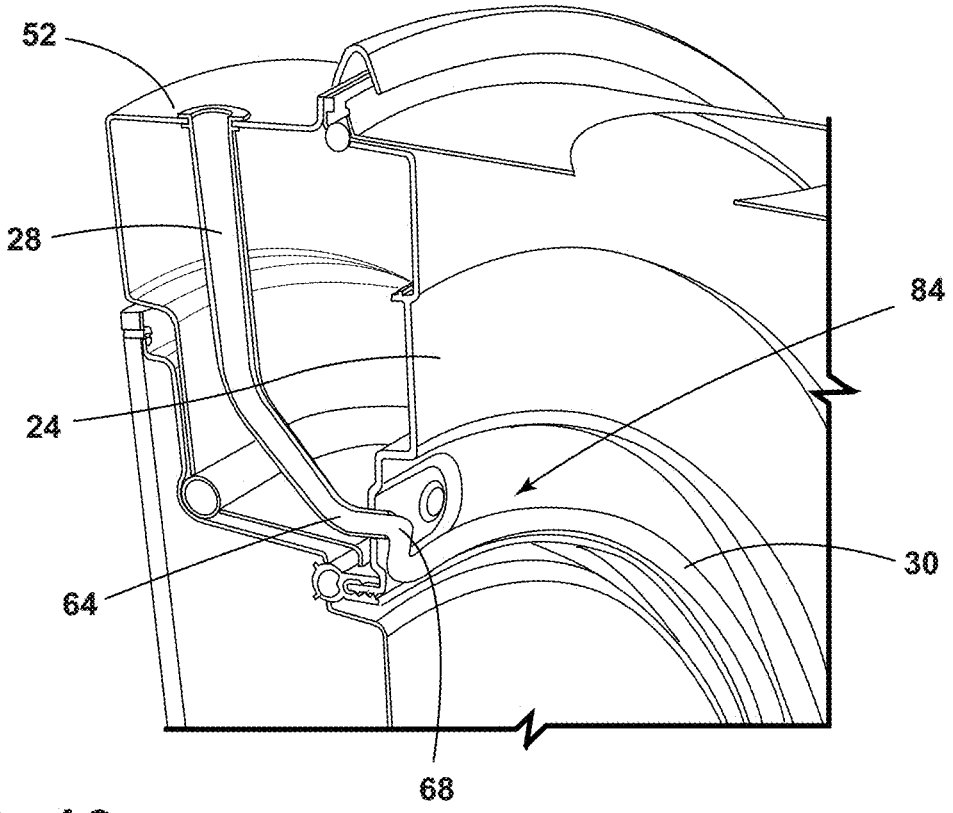
FIG. 10 is an enlarged cross-sectional view of a laundry appliance of the present disclosure with an aspect of the water recirculation assembly with an inlet tube in of frame.

In an alternate configuration illustrated in FIG. 10, the inlet tube 28 is disposed within the frame 52, as described above, and the manifold tube 30 is disposed in the space 84 between the tub 24 and the drum 22. The inlet tube 28 illustrated in FIG. 10 includes an arcuate body 90 so the inlet tube 28 is directed toward the tub 24. The second end 64 of the inlet tube 28 is operably coupled to the receiving end 68 of the manifold tube 30 in the space 84 between the tub 24 and the drum 22. It is generally contemplated that the inlet tube 28 may extend through the tub 24 to couple to the manifold tube 30. It is also contemplated that the inlet tube 28 is disposed proximate to the receiving end 68 of the manifold tube 30, but may remain uncoupled from the manifold tube 30.

Figure 11:
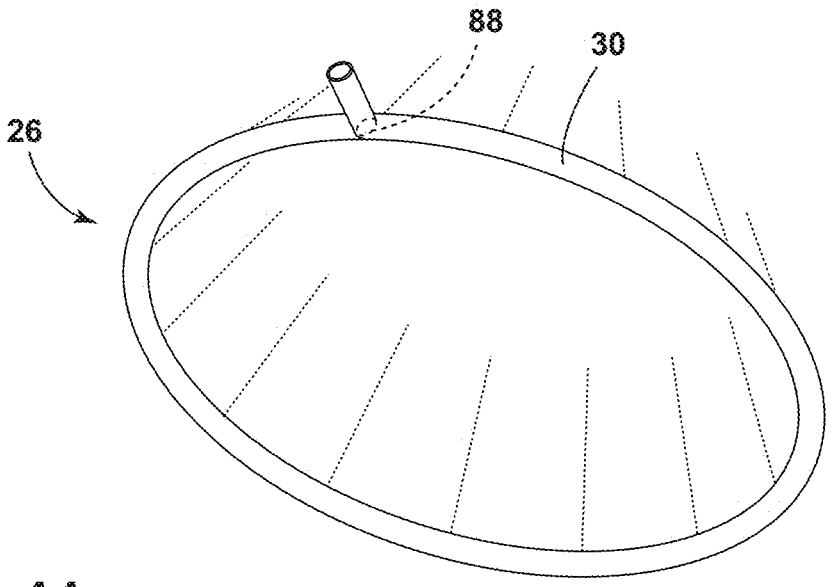
FIG. 11 is a top perspective view of a water recirculation assembly of the present disclosure.

As illustrated in FIG. 11 and as mentioned above, the manifold tube 30 has a generally circumferential configuration that can be concentrically aligned with the drum 22. It is generally contemplated that the configuration of the water recirculation assembly 26, as illustrated in FIGS. 7-11, is generally fixed relative to the tub 24. The water recirculation assembly 26 is generally constructed from a pliable material, such as rubber, and is generally flexible and resilient to minimize the overall wear of the water recirculation assembly 26. The flexibility and pliability of the water recirculation assembly 26 is also configured to increase the useful life of the water recirculation assembly 26.

Conventional appliances include a bellows that directs water into the appliance. Over time, the bellows may wear down and may build up a residue. Thus, users of conventional appliances may need to repeatedly clean the bellows to maintain the overall function and cleanliness of the appliance.

Referring again to FIGS. 1-11, the laundry appliance 10 described herein is generally free from a bellows that directs the liquid 48 into the drum 22. Rather, the water recirculation assembly 26 is configured to dispense the liquid 48 from the pump 14 into the drum 22. The water recirculation assembly 26 includes the first tube 28 and the second tube 30, which are fluidly coupled to translate the liquid 48. The configuration of the first and second tubes 28, 30 may vary depending on the configuration of the laundry appliance 10. For example, the first tube 28 may be disposed within the cabinet 12 and the second tube 30 may be disposed within the door 16 defining the gap 32 therebetween. Additionally or alternatively, the first tube 28 may be directly coupled to the second tube 30, such that the first and second tubes 28, 30 may be integrally formed. In either configuration, the water recirculation assembly 26 provides improved liquid distribution of the laundry appliance 10.

The invention disclosed herein is further summarized in the following paragraphs and is further characterized by combinations of any and all of the various aspects described therein.

According to one aspect of the present disclosure, a laundry appliance includes a cabinet that includes a pump and a door proximate to the cabinet. A tub is disposed within the cabinet and is proximate to the door and is operably coupled to the drum. A water recirculation assembly is operably coupled to the cabinet and the door and is disposed proximate to the tub. The water recirculation assembly includes a first tube that is attached to the cabinet and is operably coupled to the pump, a second tube that is operably coupled to the door, and a gap that is defined between the first tube and the second tube.

According to another aspect, a second tube includes a water distribution feature and a first tube includes an inlet feature.

According to another aspect, a water distribution feature is disposed within a door and is configured to distribute a liquid into a tub.

According to another aspect, a second tube has a receiving end that is proximate to a first tube and a curved distribution end that is proximate to a tub. The receiving end at least partially defines a gap.

According to another aspect, a receiving end of a second tube receives a liquid from a first tube, and a liquid enters a drum via a curved distribution end.

According to another aspect, a door and a second tube are coupled to a tub and are configured to move with the tub.

According to another aspect, a second tube is integrally formed with a door, and a first end of the second tube is proximate to a first tube, a central body of the second tube is disposed within the door, and a second end of the second tube extends toward a drum.

According to another aspect of the present disclosure, a laundry appliance includes a cabinet that includes a pump. A drum is disposed within the cabinet and a tub is operably coupled to the drum. A water recirculation assembly is coupled to the tub. The water recirculation assembly includes an inlet tube, and a manifold tube is coupled to the inlet tube. The manifold tube defines a plurality of apertures along at least a portion of the manifold tube.

According to another aspect, an inlet tube is operably coupled to a pump.

According to another aspect, a space is defined between a tub and a drum, and a water recirculation assembly is disposed within the space between the tub and the drum.

According to another aspect, a plurality of apertures are configured to direct a liquid into a drum.

According to another aspect, a tub includes a front covering, and a water recirculation assembly is coupled to the front covering of the tub.

According to another aspect, an inlet tube includes a linear body that has a first end and is coupled to a pump, and a second end that is coupled to a manifold tube. The manifold tube includes a circumferential body that is concentrically aligned with a drum.

According to yet another aspect of the present disclosure, a laundry appliance includes a cabinet that includes a pump. A drum is disposed within the cabinet and a tub is operably coupled to the drum and is disposed proximate to the cabinet. A water recirculation assembly is operably coupled to the pump. The water recirculation assembly includes a first tube that is operably coupled to the pump within the cabinet, a second tube that is fluidly coupled to the first tube, and a gap that is defined between the first tube and the second tube.

According to another aspect, a door is operably coupled to a tub, and a second tube is integrally formed with the door that is proximate to the tub.

According to another aspect, a second tube includes a receiving end that is proximate to a first tube and a curved distribution end that is proximate to a tub, and a first tube includes a first end and a second end.

According to another aspect, a receiving end of a second tube receives a liquid from a first tube, and the liquid enters a drum via a curved distribution end.

According to another aspect, a gap is defined between a second end of a first tube and a receiving end of a second tube.

According to another aspect, a first end of a second tube is proximate to a first tube, a central body of the second tube is disposed within a door, and a second end of the second tube extends toward a drum.

According to another aspect, a door and a second tube are coupled to a tub and are configured to move with the tub.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:
- a cabinet including a pump;
- a door proximate to the cabinet;
- a tub disposed within the cabinet and proximate to the door and operably coupled to a drum;
- a frame operably coupled to the tub; and
- a water recirculation assembly operably coupled to the frame and the door and disposed proximate to the tub, the water recirculation assembly including:
  - a first tube attached to the frame and operably coupled to the pump;
  - a second tube operably coupled to the door, the second tube including a valve proximate to the tub; and
  - a gap defined between the first tube and the second tube, wherein the first and second tubes are vertically aligned with one another across the gap when the door is in a closed position.

2. The laundry appliance of claim 1, wherein the second tube comprises a water distribution feature and the first tube comprises an inlet feature.

3. The laundry appliance of claim 2, wherein the water distribution feature is disposed within a central portion of the door and is configured to distribute a liquid into the tub.

4. The laundry appliance of claim 1, wherein the second tube has a receiving end proximate to and vertically aligned with the first tube and also includes a curved distribution end proximate to the tub, and wherein the curved distribution end includes the valve.

5. The laundry appliance of claim 4, wherein the receiving end of the second tube at least partially defines the gap and receives a liquid from the first tube, and wherein the liquid enters the drum via the curved distribution end.

6. The laundry appliance of claim 1, wherein the door and the second tube are coupled to the tub and are configured to move with the tub.

7. The laundry appliance of claim 1, wherein the second tube is integrally formed with the door, and wherein a first end of the second tube is proximate to the first tube and is vertically aligned with an end of the first tube that opens into the gap, a central body of the second tube is disposed within the door, and a second end of the second tube extends toward the drum.

8. A laundry appliance, comprising:
- a cabinet including a pump;
- a drum disposed within the cabinet;
- a tub operably coupled to the drum and disposed proximate to the cabinet; and
- a water recirculation assembly operably coupled to the pump, the water recirculation assembly including:
  - a first tube operably coupled to the pump;
  - a second tube fluidly coupled to the first tube and including a valve disposed proximate to the drum; and
  - a gap defined between the first tube and the second tube, wherein a lower end of the first tube is vertically aligned with a receiving end of the second tube, the first and second tubes configured to deliver a flow of fluid across the gap in a vertical direction.

9. The laundry appliance of claim 8, further comprising:
- a frame operably coupled to the tub, wherein the first tube is integrally formed with the frame proximate to the second tube; and
- a door operably coupled to the tub, wherein the second tube is integrally formed with the door proximate to the tub, and wherein the lower end of the first tube and the receiving end of the second tube are vertically aligned when the door is in a closed position.

10. The laundry appliance of claim 9, wherein the door and the second tube are coupled to the tub and are configured to move with the tub, and wherein the tub and the first tube are each coupled with the frame and the tub is configured to move relative to the first tube.

11. The laundry appliance of claim 8, wherein the second tube includes the receiving end proximate to the first tube and a curved distribution end proximate to the tub, and wherein the first tube includes a first end and a second end.

12. The laundry appliance of claim 11, wherein the receiving end of the second tube receives a liquid in a vertical direction from the second end of the first tube, and wherein the liquid enters the drum via the valve disposed in the curved distribution end.

13. The laundry appliance of claim 11, wherein the gap is defined between the second end of the first tube and the receiving end of the second tube.

14. The laundry appliance of claim 8, wherein the receiving end of the second tube is proximate to the first tube, a central body of the second tube is disposed within a door, and a second end of the second tube extends toward the drum, and wherein the receiving end of the second tube has a circumference larger than a circumference of the first tube.

* * * * *